US006305084B1

(12) United States Patent
Zucker

(10) Patent No.: US 6,305,084 B1
(45) Date of Patent: Oct. 23, 2001

(54) RAZOR CARTRIDGE AND CORRESPONDING METHOD OF ASSEMBLY

(75) Inventor: Shlomo Zucker, Mihmoret (IL)

(73) Assignee: Wheel Technology Ltd., Grand Cayman (KY)

( * ) Notice: Subject to any disclaimer, the term of this patent is extended or adjusted under 35 U.S.C. 154(b) by 0 days.

(21) Appl. No.: 09/515,621

(22) Filed: Feb. 29, 2000

(51) Int. Cl.[7] ..... B26B 21/16; B26B 21/22
(52) U.S. Cl. ..... 30/50; 30/47
(58) Field of Search ..... 30/41, 47, 50; 29/451, 505, 509

(56) References Cited

U.S. PATENT DOCUMENTS

| | | | | |
|---|---|---|---|---|
| 4,389,773 | | 6/1983 | Nissen et al. | 30/50 |
| 4,443,940 | * | 4/1984 | Francis et al. | 30/50 |
| 4,985,995 | * | 1/1991 | Coffin | 30/50 |
| 5,056,222 | | 10/1991 | Miller et al. | 30/77 |
| 5,063,667 | | 11/1991 | Jacobson | 30/41 |
| 5,388,332 | * | 2/1995 | Oldroyd | 30/50 |
| 5,402,574 | | 4/1995 | Milner | 30/50 |
| 5,781,997 | | 7/1998 | Ferraro et al. | 30/50 |
| 5,822,862 | | 10/1998 | Ferraro | 30/50 |

* cited by examiner

*Primary Examiner*—Hwei-Siu Payer
(74) *Attorney, Agent, or Firm*—Mark M. Friedman

(57) ABSTRACT

A razor cartridge employs a number of planar blades, each having an uninterrupted upper surface and a width measured across its upper surface perpendicular to its length of no more than about 4 mm. The blades are retained between abutment features provided by spaced-apart ribs of a base and opposing abutment surfaces of a cover. Also provided is method for assembling such cartridges by temporarily inserting locating elements through apertures formed either in the base or in the cover.

11 Claims, 13 Drawing Sheets

RAZOR CARTRIDGE AND CORRESPONDING METHOD OF ASSEMBLY

FIELD AND BACKGROUND OF THE INVENTION

The present invention relates to razors and, in particular, it concerns a razor cartridge employing narrow blades, and a method for assembling such cartridges.

Modern razor cartridges typically employ one of two techniques for retaining blades in position within the cartridge. The first employs a plurality of pins projecting from one of the cartridge elements which engage locating holes formed through each blade. An example of such a structure is U.S. Pat. No. 4,860,449 to Duncan.

The presence of locating holes within the blades required a certain minimum width of blade to ensure the structural integrity of the blades. Thus, blades of this type are typically at least about 5.5 mm wide. Since the total width of the cartridge is typically of the order of 10 mm, the use of two 5.5 mm blades requires that the blades are set in overlapping relation with a spacer element therebetween. This overlap greatly limits the area of drainage channels between the blades for flushing out hair and dirt, thereby leading to clogging of the cartridge.

In an attempt to reduce overlap between the blades, The Gillette Company® has developed a second blade retention technique which employs brazing of narrow blades onto a bent-over metal support element. An example of the resulting structure may be found in U.S. Pat. No. 5,056,222 to Miller et al.

The Gillette approach avoids the need for forming holes in the blades, thereby allowing a reduction in width of the blades to eliminate overlap and provide better drainage channels. This, however, is achieved at considerable cost. Specifically, the production techniques during which the blades are brazed onto the support elements are complex and expensive, leading to increased cost of the cartridge as a whole.

There is therefore a need for a razor cartridge which would employ narrow blades of no more than about 4 mm width without requiring either holes formed through the blades or brazing of the blades to support elements. It would also be highly advantageous to provide a method for assembling such a razor cartridge.

SUMMARY OF THE INVENTION

The present invention is a razor cartridge employing narrow blades, and a method for assembling such a cartridge.

According to the teachings of the present invention there is provided, a razor cartridge comprising: (a) a plurality of substantially planar blades, each of the blades having a cutting edge extending along substantially all of a major dimension termed length, each of the blades having an uninterrupted upper surface, a lower surface, and a width measured across the upper surface perpendicular to the length of no more than about 4 mm; (b) a base having at least one series of spaced-apart ribs configured to provide abutment features for abutting the lower surface of each of the blades so as to define at least partially a predetermined mounting position of each of the blades; and (c) a cover configured for engaging the base to form a unitary cartridge structure, the cover providing at least one abutment surface for each of the blades, the at least one abutment surface being configured to abut the upper surface of a corresponding one of the blades, thereby pressing the blade against the corresponding series of abutment features so as to retain the blade in the predetermined mounting position.

According to a further feature of the present invention, each of the spaced-apart ribs provides at least two projecting abutment features, the projecting abutment features defining localized regions of abutment with the lower surface.

According to a further feature of the present invention, the plurality of blades is implemented as three blades.

According to a further feature of the present invention, the spaced-apart ribs define a mounting position for each of the blades such that the blades are non-overlapping.

According to a further feature of the present invention, the spaced-apart ribs define mounting positions for the blades in which the upper surfaces are non-parallel.

According to a further feature of the present invention, there are also provided a plurality of projecting locating elements integrally formed with, and projecting from, one of the base and the cover so as to define a plurality of blade-receiving receptacles, each of the blade-receiving receptacles being configured to have a width slightly less than a width of each of the blades.

There is also provided according to the teachings of the present invention, a method for assembling a razor cartridge of a type having a plurality of narrow blades retained between two cartridge components which provide opposing sets of blade abutment features, the method comprising: (a) temporarily inserting a plurality of locating elements through a plurality of apertures formed through a first of the cartridge components so as to define a plurality of blade-receiving receptacles; (b) inserting a blade into each of the blade-receiving receptacles; (c) attaching the second of the cartridge components to the first cartridge component so as to form a razor cartridge with the blades retained between the two cartridge components; and (d) withdrawing the locating elements from the first cartridge component.

According to a further feature of the present invention, the withdrawing is performed substantially simultaneously with the attaching.

According to a further feature of the present invention, the locating elements are spring-mounted so as to be retractable, at least part of the withdrawing being achieved as a direct result of contact between the locating elements and the second cartridge element during the attaching.

According to a further feature of the present invention, each of the blade-receiving receptacles is configured to have a width slightly less than a width of each of the blades such that the inserting of the blades results in the blades being temporarily wedged within the blade-receiving receptacles.

There is also provided according to the teachings of the present invention, a method for assembling a razor cartridge of a type having a plurality of narrow blades retained between two cartridge components which provide opposing sets of blade abutment features, the method comprising: (a) providing a plurality of projecting locating elements projecting from a first of the cartridge components so as to define a plurality of blade-receiving receptacles, each of the blade-receiving receptacles being configured to have a width slightly less than a width of each of the blades; (b) inserting a blade into each of the blade-receiving receptacles so that it becomes wedged between adjacent ones of the locating elements; and (c) attaching the second of the cartridge components to the first cartridge component so as to form a razor cartridge with the blades retained between the two cartridge components, the second cartridge component being formed with a plurality of recesses for receiving the projecting locating elements.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a razor cartridge employing narrow blades, and a method for assembling such a cartridge.

The principles and operation of razor cartridges according to the present invention may be better understood with reference to the drawings and the accompanying description.

Figure 1:
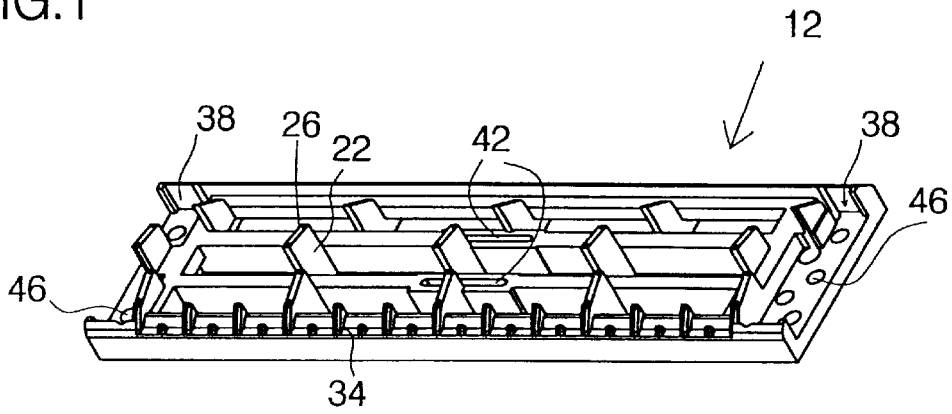
FIG. 1 is an isometric view of a base of a razor cartridge, constructed and operative according to the teachings of the present invention.
Figure 2:
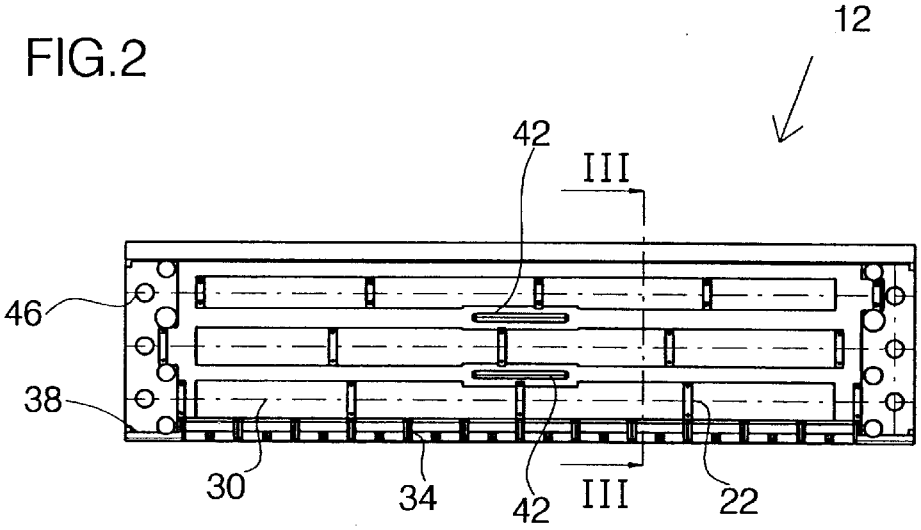
FIG. 2 is a plan view of the base of FIG. 1.
Figure 3:
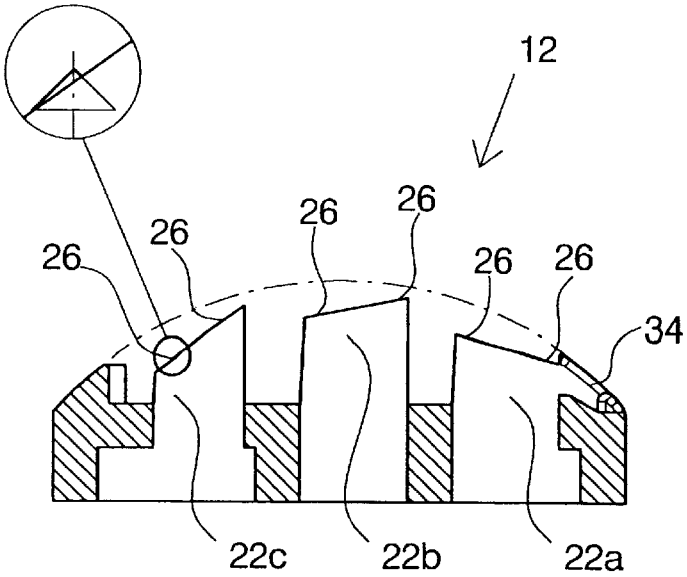
FIG. 3 is a cross-sectional view taken along the line III—III of FIG. 2.
Figure 4:
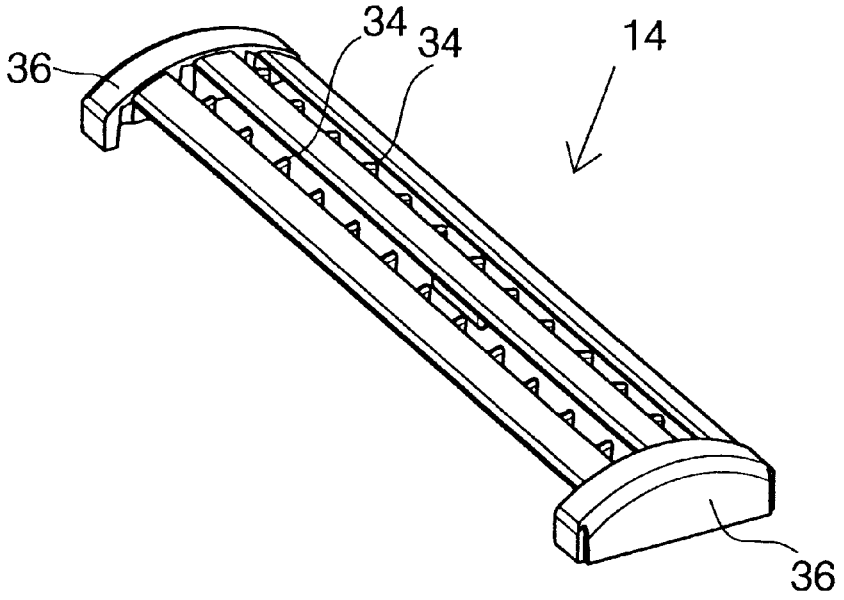
FIG. 4 is an upper isometric view of a cover of a razor cartridge, constructed and operative according to the teachings of the present invention.
Figure 5:
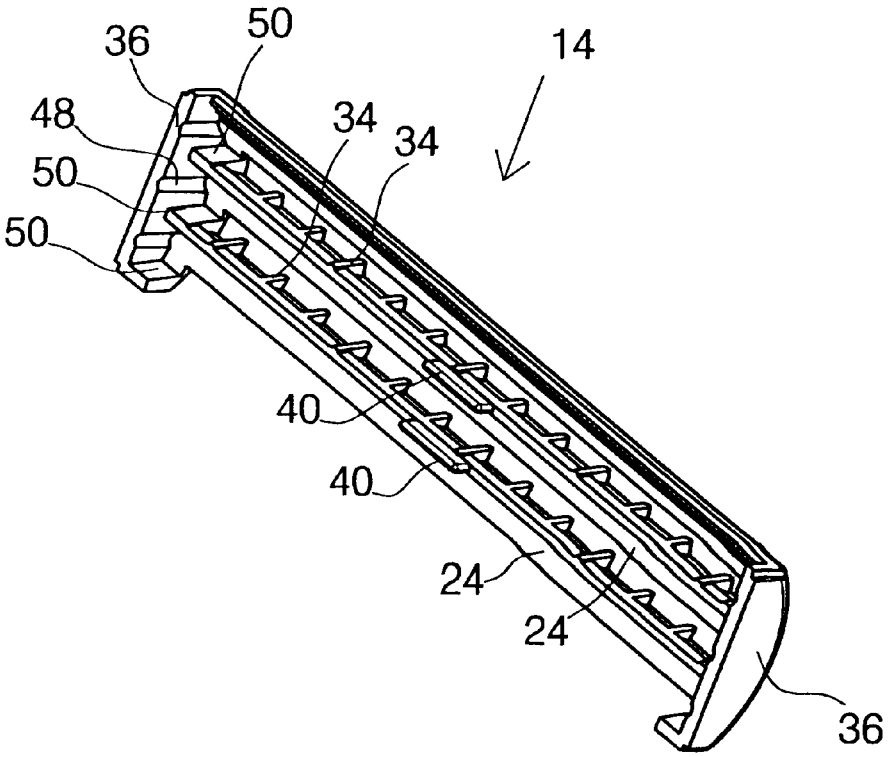
FIG. 5 is a lower isometric view of the cover of FIG. 4.
Figure 6:
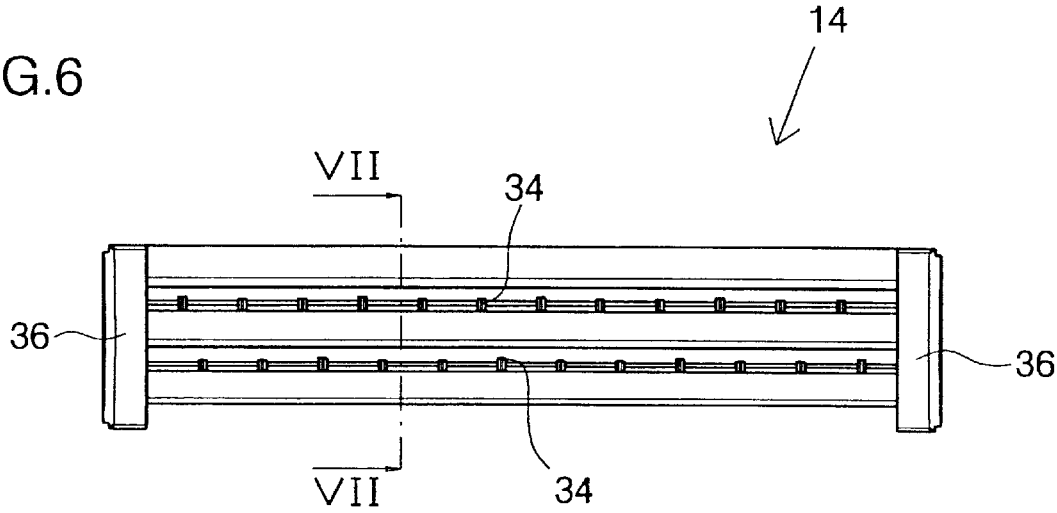
FIG. 6 is a plan view of the cover of FIG. 4.

Referring now to the drawings, FIGS. 1–12 illustrate a razor cartridge, constructed and operative according to the teachings of the present invention. More specifically, FIGS. 1–3 show a base element 12, FIGS. 4–7 show a cover element 14 and FIGS. 8–12 show the razor cartridge, generally designated 10, assembled from base 12, cover 14 and a plurality of blades 16. The method for assembling such a razor cartridge will be described separately with reference to FIGS. 13–18, below.

Referring now to the main features of the cartridge of the present invention in general terms, blades 16 (best seen in FIGS. 12 and 14, the latter to be described in more detail below in the context of the method of the present invention) are substantially planar, each having a cutting edge 18 extending along substantially all of a major dimension termed length L. It is a particular feature of most preferred implementations of the present invention that each of the blades has an uninterrupted upper surface 20, i.e., without any locating holes or other openings. This allows the use of narrow blades without compromising the mechanical integrity required of the blades.

Base 12 has at least one series of spaced-apart ribs 22*a*, 22*b* and 22*c* configured to provide abutment features for abutting the lower surface of each of blades 16 so as to at least partially define a predetermined mounting position of each blade 16.

Cover 14 is configured to engage base 12 to form a unitary cartridge structure. Cover 14 provides at least one abutment surface 24*a*, 24*b* and 24*c* configured to abut upper surface 20 of each blade 16, thereby pressing the blade against the corresponding series of abutment features so as to retain the blade in the predetermined mounting position.

In the context of the description and claims, the term "narrow blade" is used to refer to blades having a width W, measured across upper surface 20 perpendicular to the length L, of no more than about 4 mm. In fact, the preferred width for blades 16 according to the present invention is in the range from about 1.5 to about 2.5 mm, and most preferably, about 2 mm. It will be immediately apparent to one of ordinary skill in the art that such narrow blades cannot be retained by conventional techniques of pins engaging locating holes without compromising the structural integrity of the blades.

Base 12 and cover 14 are preferably made from plastic materials which are bonded together during assembly, such as by use of a solvent, to produce a unitary cartridge. Such a cartridge may be used either as a fixed part of a disposable razor, or as an interchangeable cartridge for a reusable razor, as is known in the art.

Turning now to the features of razor cartridge 10 in more detail, base element 12 is seen most clearly in FIGS. 1–3. In the particular preferred example shown, cartridge 10 employs three blades. Base element 12 thus correspondingly features three sets of abutment features 26. In the preferred case shown, each set of abutment features is provided by a separate set of flat ribs, designated 22*a*, 22*b* and 22*c*, respectively.

In order to accommodate any slight variations in manufacturing tolerances, abutment features 26 are preferably implemented as two projecting abutment features 26 on each rib 22 configured to define localized regions of abutment with the lower surface of the blades. These projecting features are preferably formed so as to define a contact area which is at least one, and more preferably at least two, orders of magnitude less than the contact area between the upper surfaces of the blades and the abutment surfaces 24 of cover 14. In the example illustrated (FIGS. 3 and 12), this is achieved by implementing abutment features 26 as small pointed projections. This allows the abutment features 26 to deform slightly so as to conform to the exact position of the blade as it becomes seated under slight pressure of cover 14 during assembly. Thus it is the abutment geometry of cover 14 which preferably serves to determine the precise alignment of the blades within cartridge 10, as will be detailed below.

The use of flat ribs deployed so as to present a narrow edge in the cutting direction leaves large open drainage channels 28 between the ribs. In the case shown, the positions of the sets of ribs are slightly staggered along the length of the cartridge, corresponding to the staggering of skin guide elements in front of different blades as will be described below.

Figure 12:
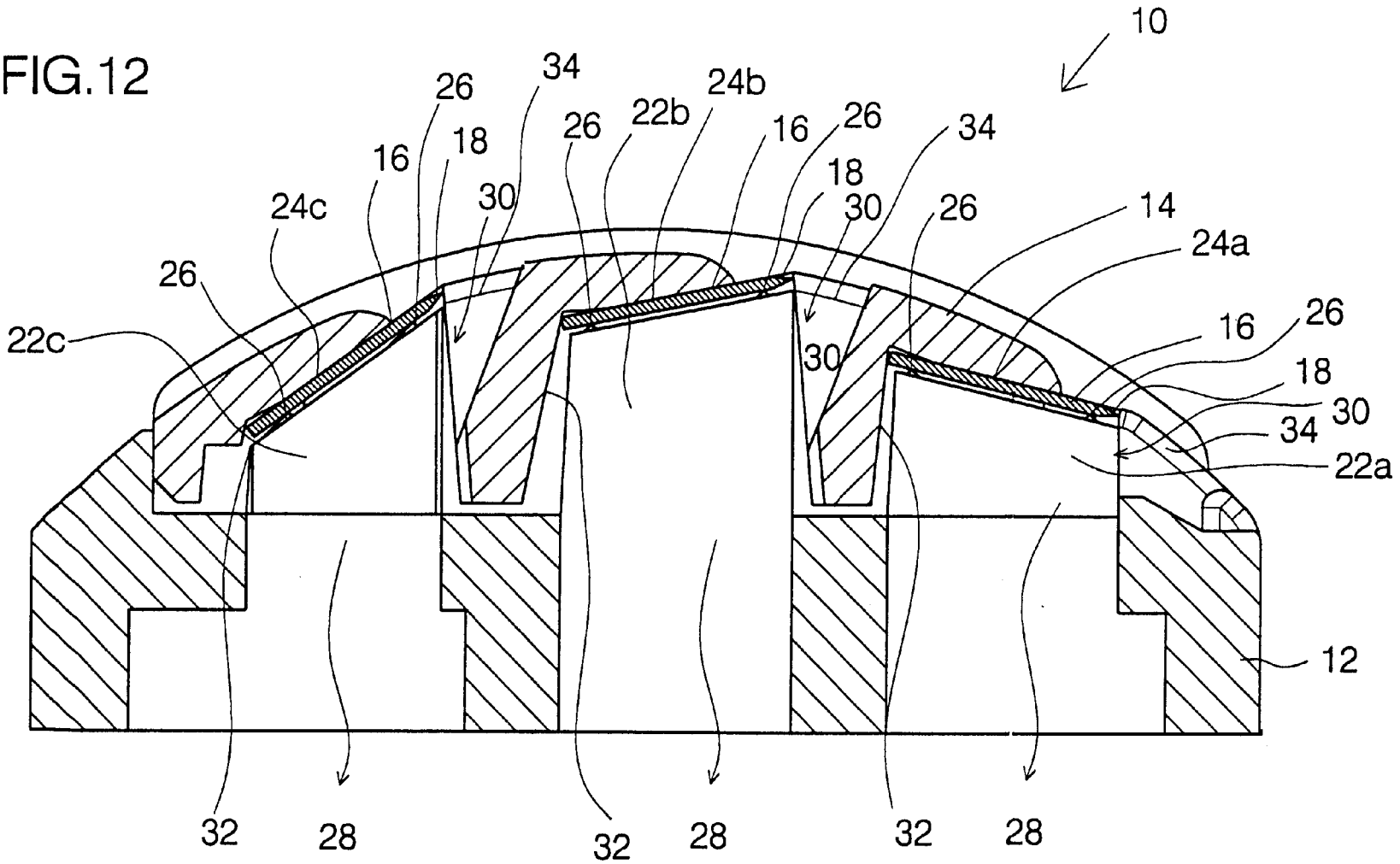
FIG. 12 is a cross-sectional view taken along line XII—XII of FIG. 10.

A particular advantage of the use of narrow blades as herein defined is the provision of effective drainage channels between the blades themselves. To this end, it is a preferred feature of most preferred implementations of the present invention that spaced-apart ribs 22*a,* 22*b* and 22*c* define mounting positions for each of blades 16 such that the blades are non-overlapping. In the case of a flat skin-contact profile, "non-overlapping" is taken to mean that the blades do not overlap as viewed perpendicular to the plane of skin contact. In the case of a curved skin-contact profile, such as the preferred convexly curved skin-contact profile shown here, the term "non-overlapping" is defined in relation to a plane tangential to the skin-contact profile (defined by the outward-facing surfaces of cover 14) adjacent to the cutting edge of the rearward of two adjacent blades. Specifically, two blades are defined to be "non-overlapping" if the geometric projection of the cutting edge of the more rearward blade in a direction perpendicular to the aforementioned tangential plane does not intersect the preceding blade. This property allows the provision of drainage openings 30 ahead of each blade which interconnect with drainage channels 28, as seen in FIG. 12.

According to a preferred feature of the present invention as illustrated here, cartridge 10 provides a convexly curved contact profile with the skin of the user, the blades being spaced around the contact profile. As a result, in order to ensure an appropriate attack angle of each blade, the spaced-apart ribs are configured to define mounting positions for the blades in which the upper surfaces are non-parallel. Further preferred features of the skin contact profile and blade positioning are described in detail in U.S. patent application Ser. No. 09/219,372, filed Dec. 23, 1998, now U.S. Pat. No. 6,055,731, and PCT Patent Application No. PCT/US99/30533, which are both hereby incorporated by reference in their entirety.

Figure 7:
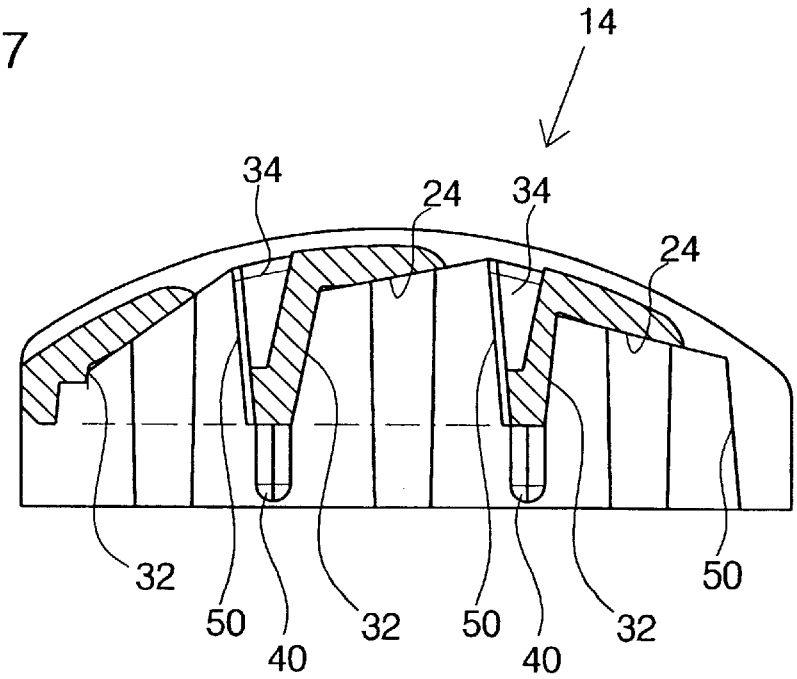
FIG. 7 is a cross-sectional view taken along the line VII—VII of FIG. 6.
Figure 8:
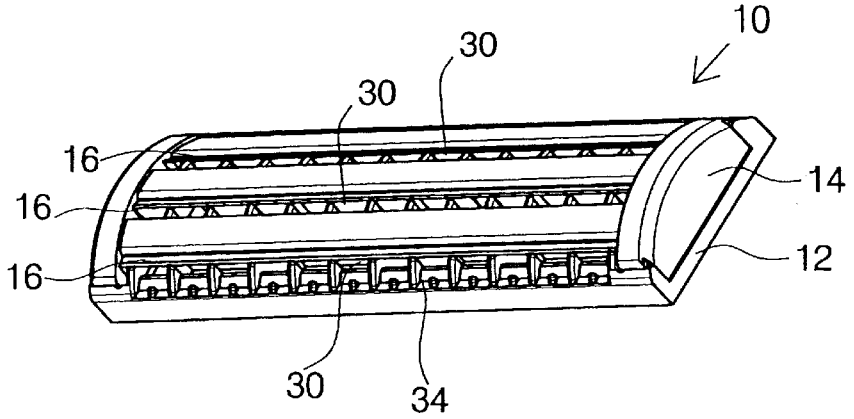
FIG. 8 is an upper isometric view of a razor cartridge, constructed and operative according to the teachings of the present invention, employing the base of FIG. 1 and the cover of FIG. 4.
Figure 9:
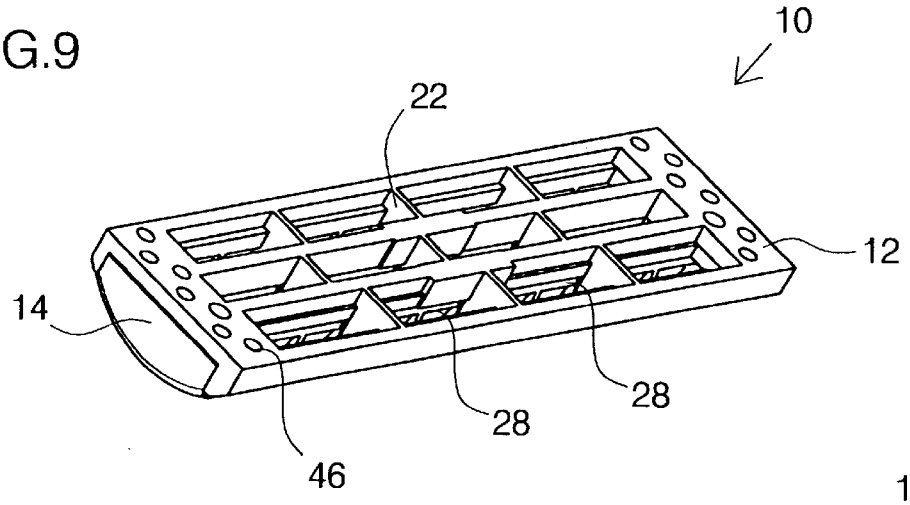
FIG. 9 is a lower isometric view of the razor cartridge of FIG. 8.
Figure 10:
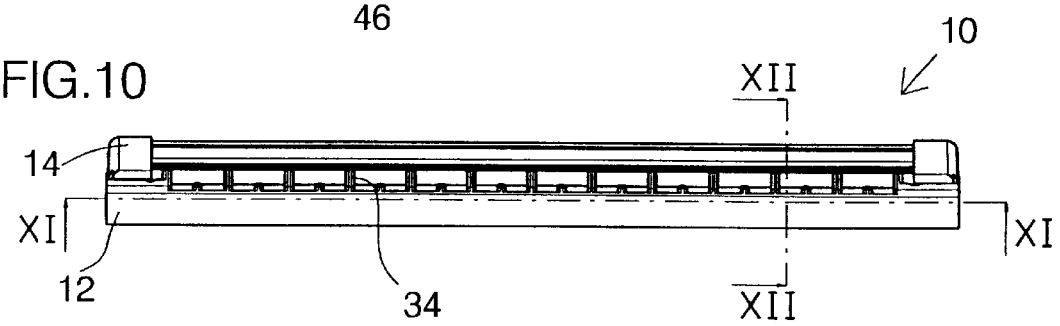
FIG. 10 is a front view of the razor cartridge of FIG. 8.
Figure 11:
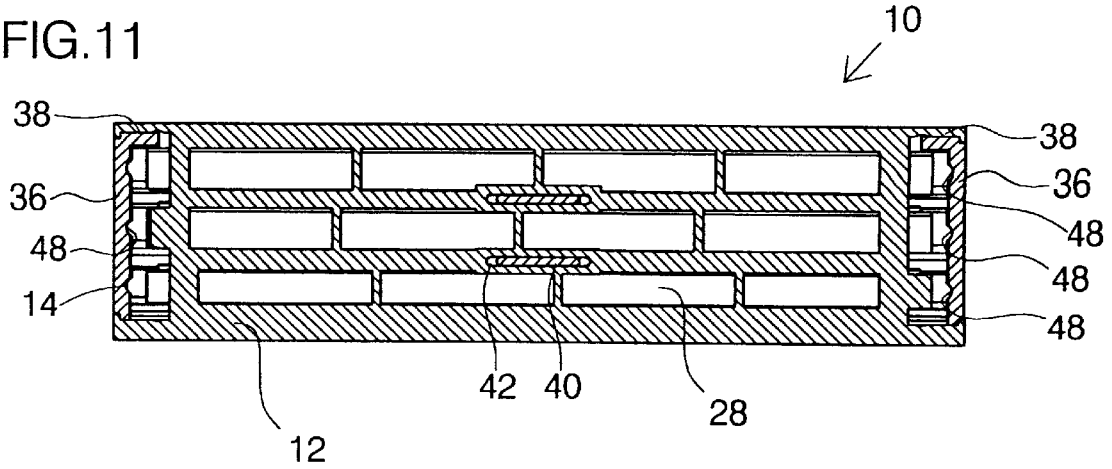
FIG. 11 is a cross-sectional view taken along line XI—XI of FIG. 10.

Turning now to cover 14 in more detail, this is shown separately in FIGS. 4–7. In addition to an abutment surface 24 corresponding to each blade position, cover 14 is preferably also formed with various positioning features for preventing displacement of each blade forwards of backwards from its intended position. Thus, as best seen in FIGS. 7 and 12, cover 14 provides a rear abutment surface 32 behind each abutment surface 24 configured to abut the rear edge of each blade 16. An equivalent function is provided, primarily at the sides of the cartridge, at the front edge of each blade, i.e., adjacent to the cutting edge, by front abutment surfaces 50 best seen in FIG. 5. As seen in FIGS. 7 and 12, rear abutment surfaces 32 and front abutment surfaces 50 together form what is effectively a wedge-shaped ridge which is inserted between adjacent blades. The inclination of these surfaces tends to center blades 16 in their predefined positions as cover 14 is brought into engagement with base 12, subsequently retaining the blades safely in the required position during use.

A set of skin guide ridges 34 are also preferably provided, spaced along the length of the cutting edge and adjacent thereto. In the case of the forward-most blade, the corresponding skin guide ridges 34 are preferably mounted on base 12, as seen in FIGS. 1–3. The use of such an arrangement of skin guide ridges 34 positioned ahead of, and substantially adjacent to, the cutting edges to form a safety-blade configuration is detailed in U.S. patent application Ser. No. 09/009,410 filed Jan. 20, 1998, now abandoned, published as PCT publication no. WO99/36233, which is hereby incorporated by reference. The ridges lie above the cutting plane defined by the direction of motion of the cutting edge as it moves in contact with the skin, and are spaced along the cutting edge so as to prevent the blade from cutting the skin. Since each ridge causes a small region of skin to be lifted slightly away from the cutting edge, the positions of ridges 34 are preferably slightly staggered between the different blades so that they do not follow each other across the skin. Preferably, to minimize obstruction to drainage channels 28, ribs 22 are aligned behind some of ridges 34. This accounts for the aforementioned slight staggering of ribs 22 between the different rows. Skin guide ridges 34 may serve a secondary function, providing additional retention of the intermediate part of blades 16 against slipping forwards.

As mentioned earlier, cover 14 is configured to engage with base 12 to form cartridge 10. To this end, in the example shown, cover 14 has end portions 36 which are configured to mate with corresponding sockets 38 formed at the ends of base 12. Preferably, end portions 36 and sockets 38 are configured not to close against each other completely on assembly so as to ensure that contact pressure is not diverted away from the blade surfaces. Attachment of cover 14 to base 12, as well as additional structural rigidity, is preferably provided by engagement of one or more tabs 40 within slots 42 (see FIGS. 1, 5 and 11). The various contact surfaces, including tabs 40 within slots 42, end portions 36 within sockets 38 and abutment surfaces along the rear edges of base 12 and cover 14, are preferably bonded together by the use of small quantities of solvent, or by any other desired technique, as is known in the art.

Turning now to the assembly method of the present invention, this will now be described with reference primarily to FIGS. 13–18. The use of narrow blades as provided by the razor cartridge structures of the present invention presents particular problems for the production of the cartridge. Specifically, blades of such small dimensions are very light and easily displaced by any slight air movement, or by proximity to surfaces charged with static electricity. As a result, it us difficult to achieve and maintain correct positioning of the blades during assembly of the cartridge.

To address this problem, the present invention provides a method for assembling a razor cartridge of a type having a plurality of narrow blades 16 retained between two cartridge components, in this case base 12 and cover 14, which provide opposing, sets of blade abutment features.

Figure 13:
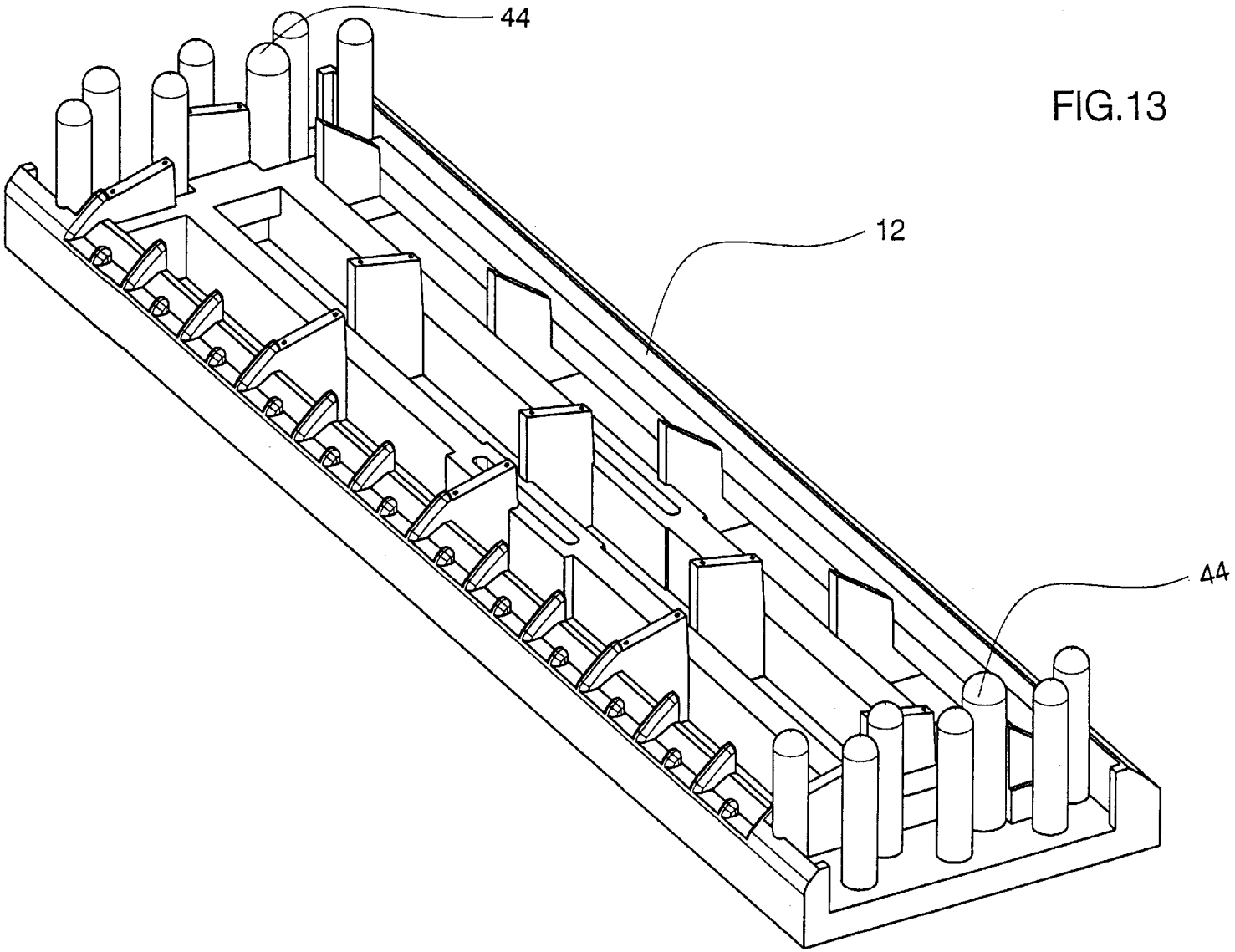
FIGS. 13–15 are a sequence of isometric views illustrating a method of assembling the razor cartridge of FIG. 8 according to the teachings of the present invention.
Figure 14:
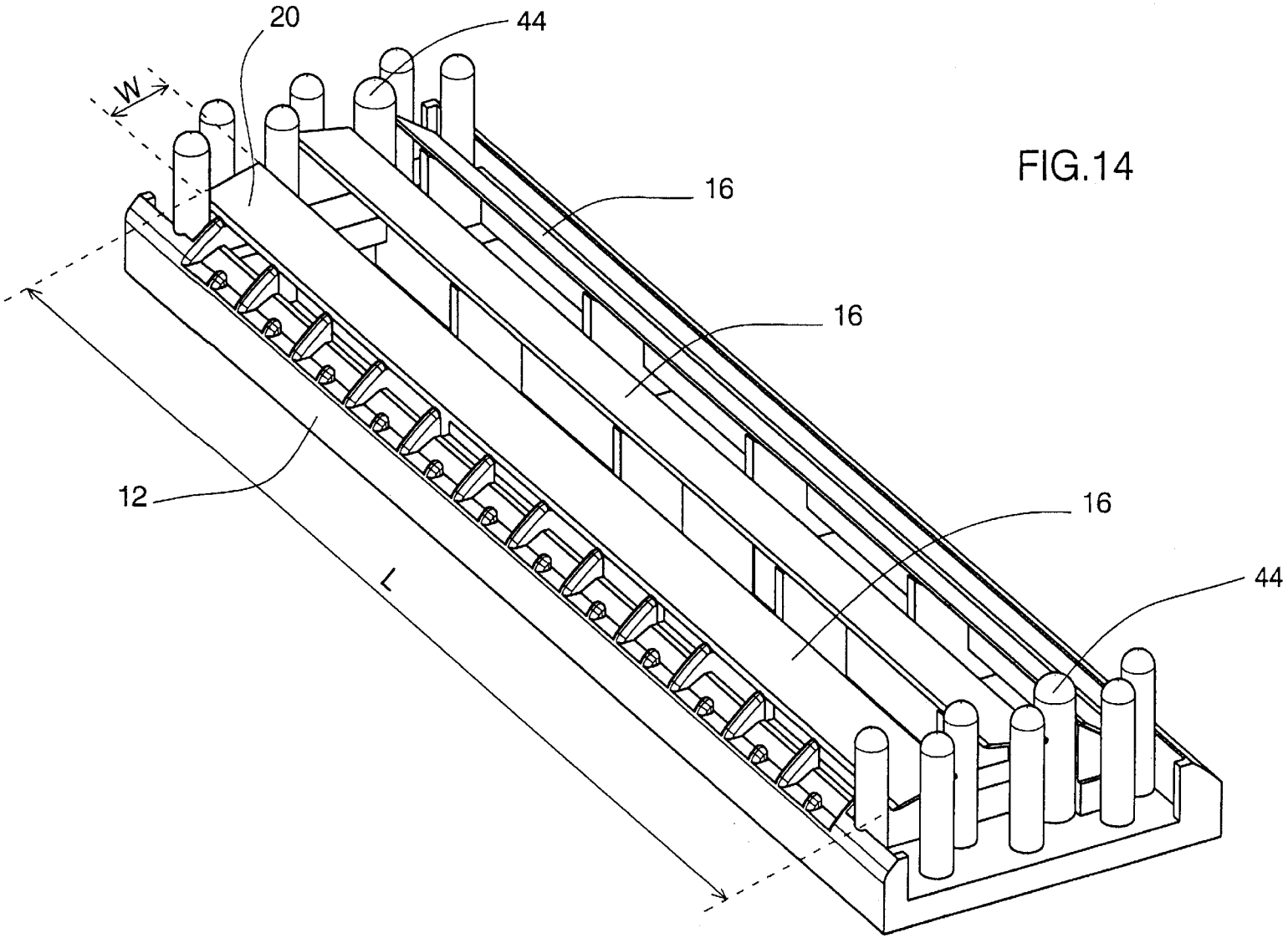
Figure 15:
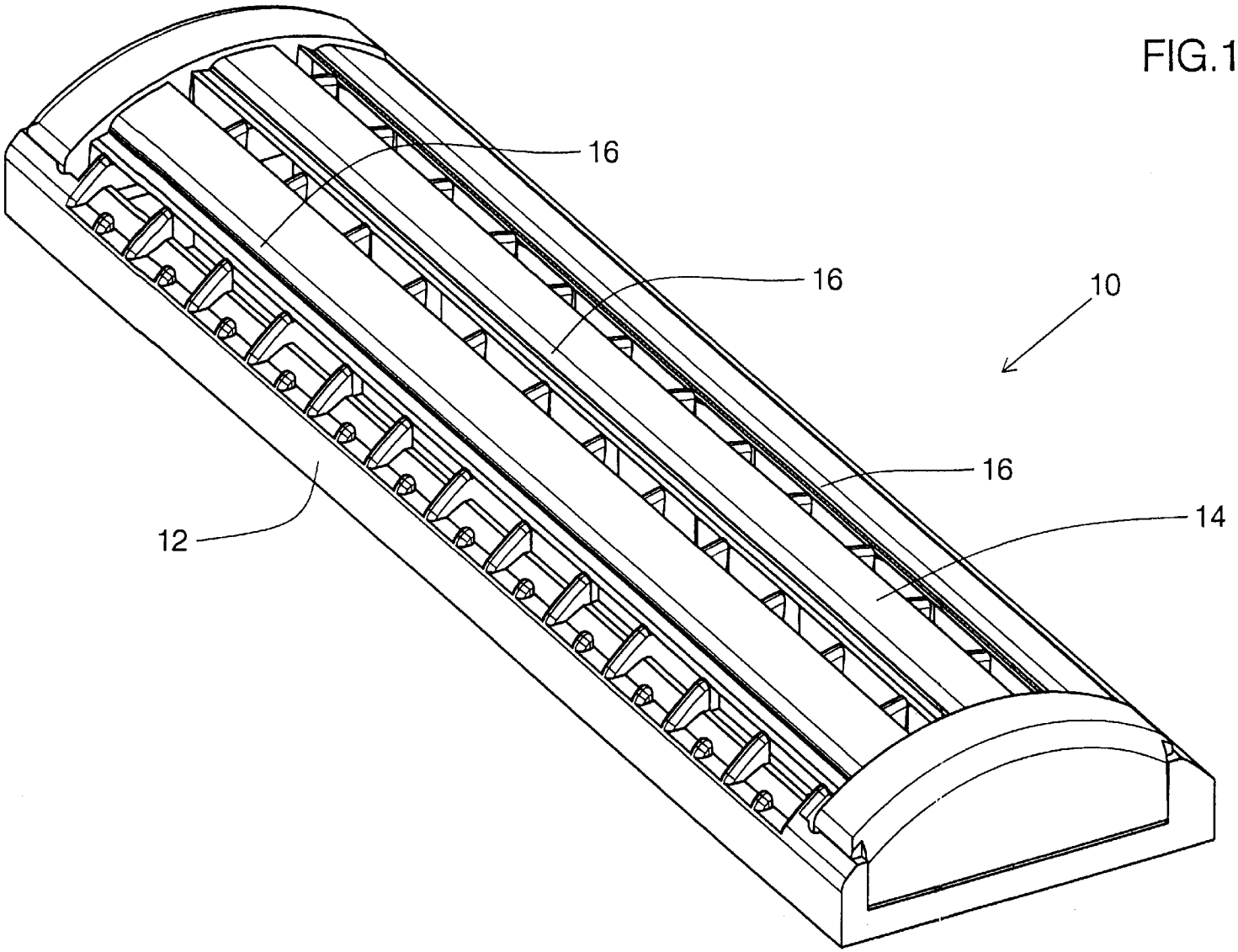
Figure 16:
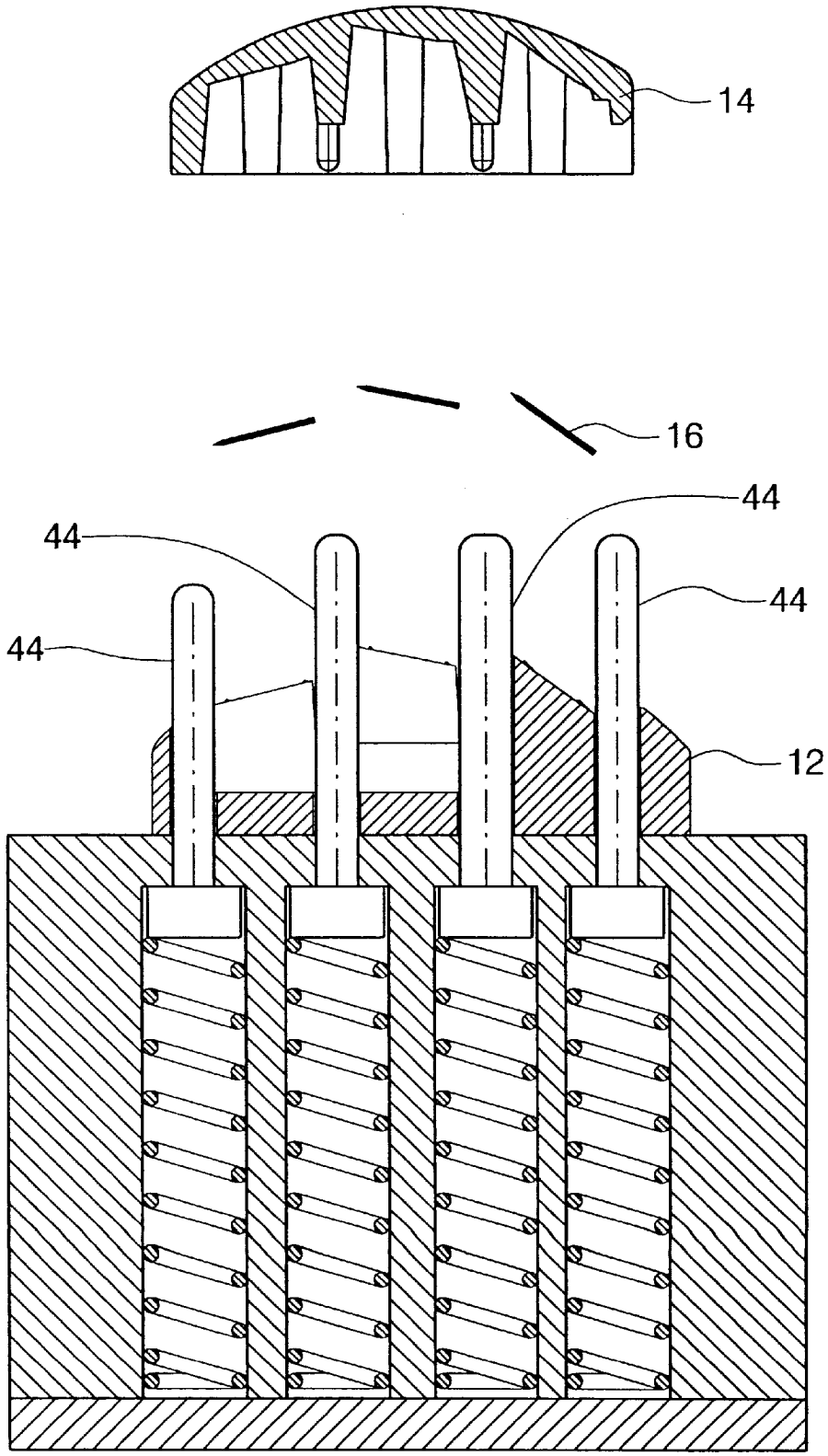
FIGS. 16–18 are a sequence of side cross-sectional views, paralleling the states of FIGS. 13–15, respectively.
Figure 17:
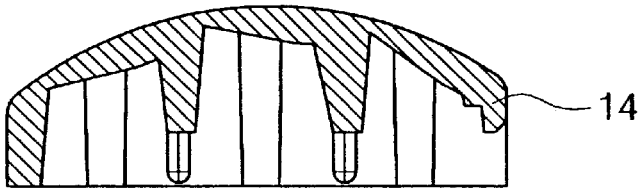
Figure 17:
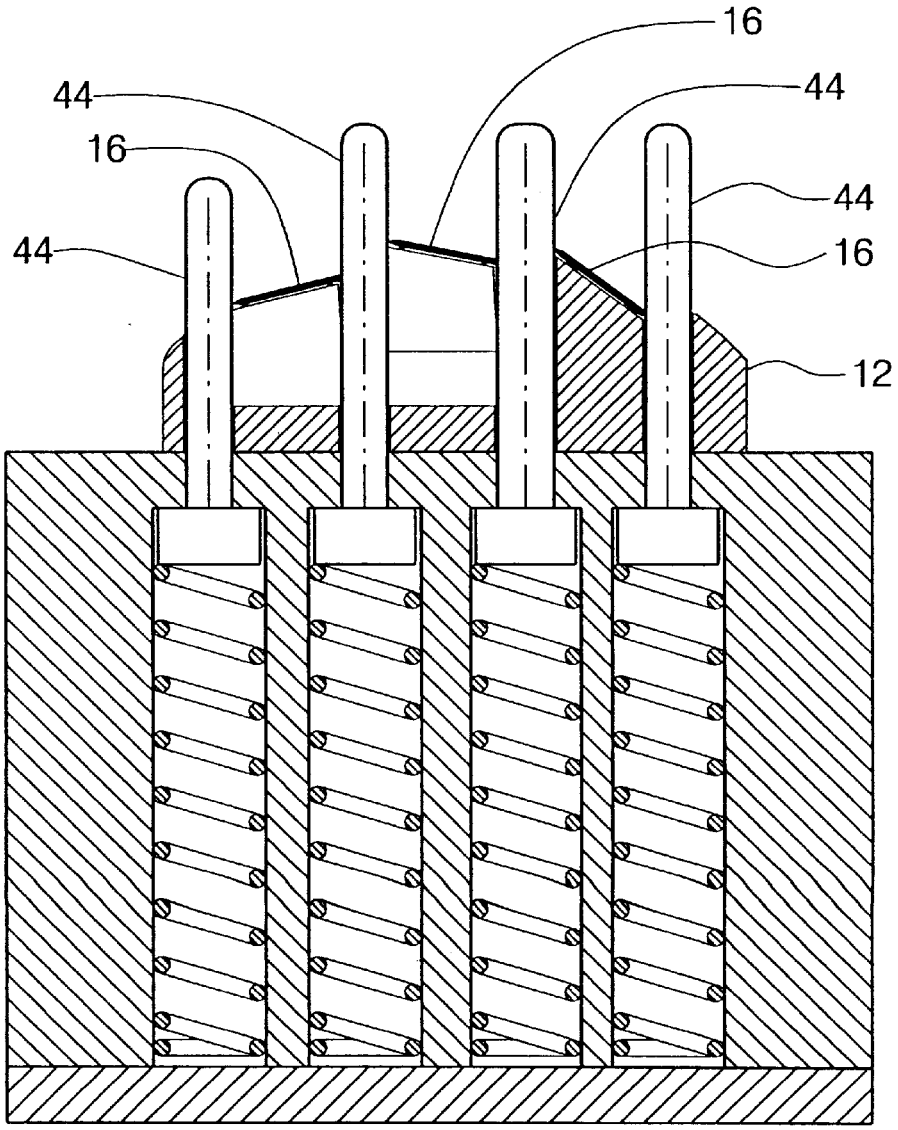
Figure 18:
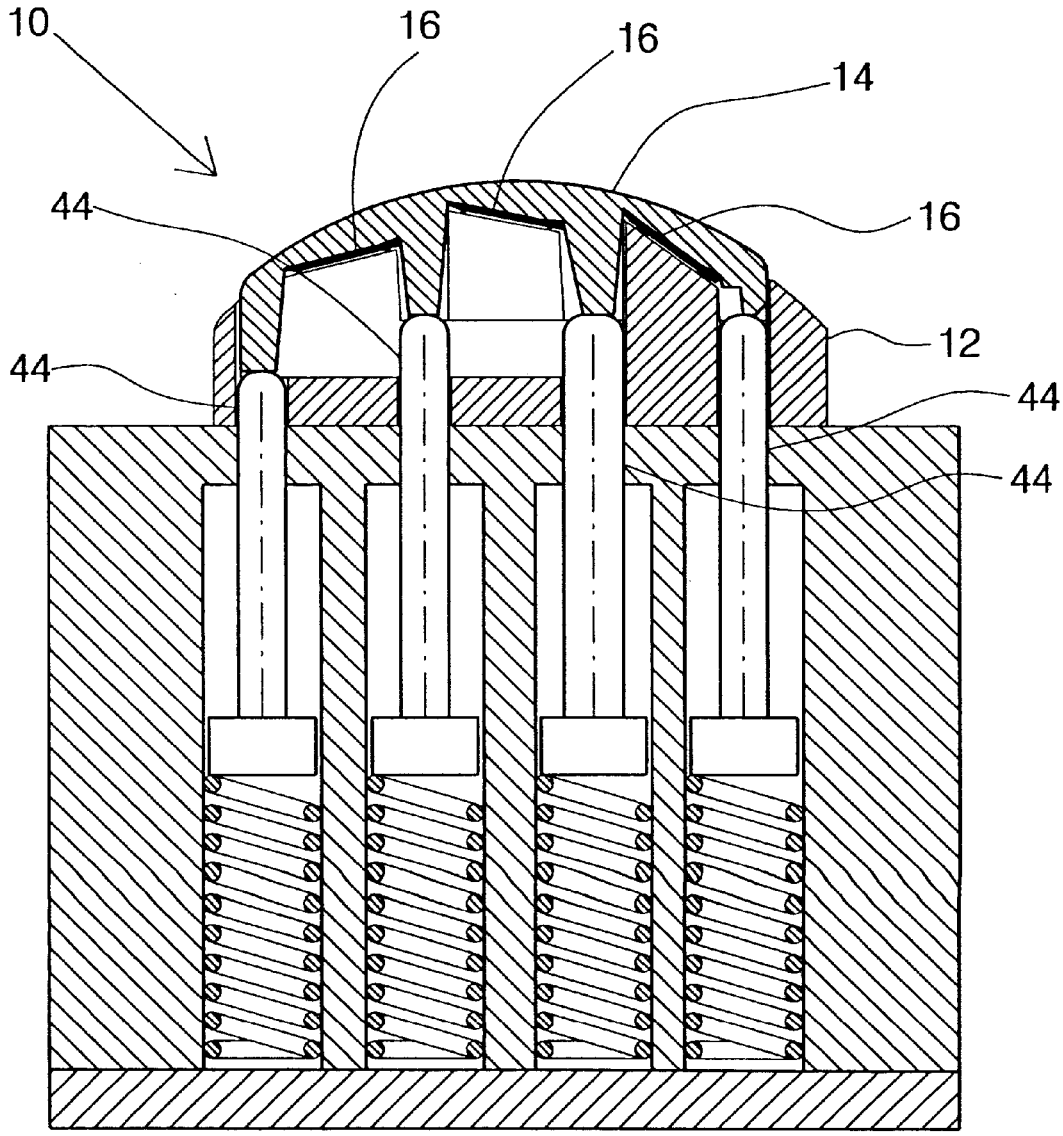

The method starts by temporarily inserting a plurality of locating elements 44 through a plurality of apertures 46 formed through a first of the cartridge components, in this case base 12, so as to define a plurality of blade-receiving receptacles (FIGS. 13 and 16). A blade is then inserted into each of the blade-receiving receptacles (FIGS. 14 and 17). Once the blades are correctly positioned, the second of the cartridge components is attached to the first cartridge component so as to complete the razor cartridge structure and the locating elements are withdrawn (FIGS. 15 and 18).

In the preferred implementation illustrated, apertures 46 are arranged in a zigzag formation across each end of the base for receiving locating elements 44 implemented as pins. In this case, one pin serves to delimit the extreme position of each end of each blade, while two additional pins delimit the front and rear edges of each blade. A single pin is preferably used between adjacent blades to delimit the front of one and the rear of the other.

Preferably, withdrawal of locating elements 44 is performed substantially simultaneously with the attachment of the second cartridge component. FIGS. 16–18 show schematically a preferred implementation of a device for use in assembling razor cartridges according to this feature of the present invention. In this case, locating elements 44 are spring-mounted so as to retract when pushed. At least part of the withdrawal of the locating elements preferably occurs as a direct result of contact between the locating elements and the second cartridge element as it is attached (see FIG. 18). In the case of cartridge 10 described above, in order to delay the withdrawal until the cover is sufficiently inserted to prevent the blades from being displaced, cover 14 preferably features recessed channels 48 (see FIG. 5) to accommodate the end portion of the locating elements.

It is a particularly preferred feature of most implementations of the method of assembly that each of the blade-receiving receptacles is configured so that the blades become slightly wedged into position when inserted. This helps to prevent displacement of the blades by air movement etc. during assembly. More specifically, the wedging-in effect preferably results from the blade-receiving receptacles having a width slightly less than the width of the blades. The wedging effect causes slight damage to the edges of the blades. For this reason, locating elements 44 are preferably inserted through apertures 46 positioned near the ends of the cartridge where the cutting edges of the blades are not operative.

In order to facilitate insertion of the blades and to ensure that the blades only become wedged-in when they reach the correct position, locating elements 44 are preferably slightly upwardly tapered. The angle of the taper can typically be small, such that it is not readily detectable in the illustration as shown. The length of the locating elements is preferably chosen to be greater than the thickness of the assembled cartridge, thereby defining guide channels which helps to align the blades during positioning, such as by robotic manipulators.

It should be noted that the method of assembly described herein is not limited to the particular cartridge structure described above. For example, the method may readily be reversed so that the locating elements are inserted through the cover rather than the base. Furthermore, the method may readily be applied to any other cartridge structure where there exist problems of maintaining blade alignment during assembly.

Finally, it should be appreciated that, in certain preferred cases, a conceptually similar method of assembly may be implemented using projecting locating elements formed as fixed parts of one of the cartridge components. One such implementation will now be illustrated with reference to FIGS. 19 and 20.

Figure 19:
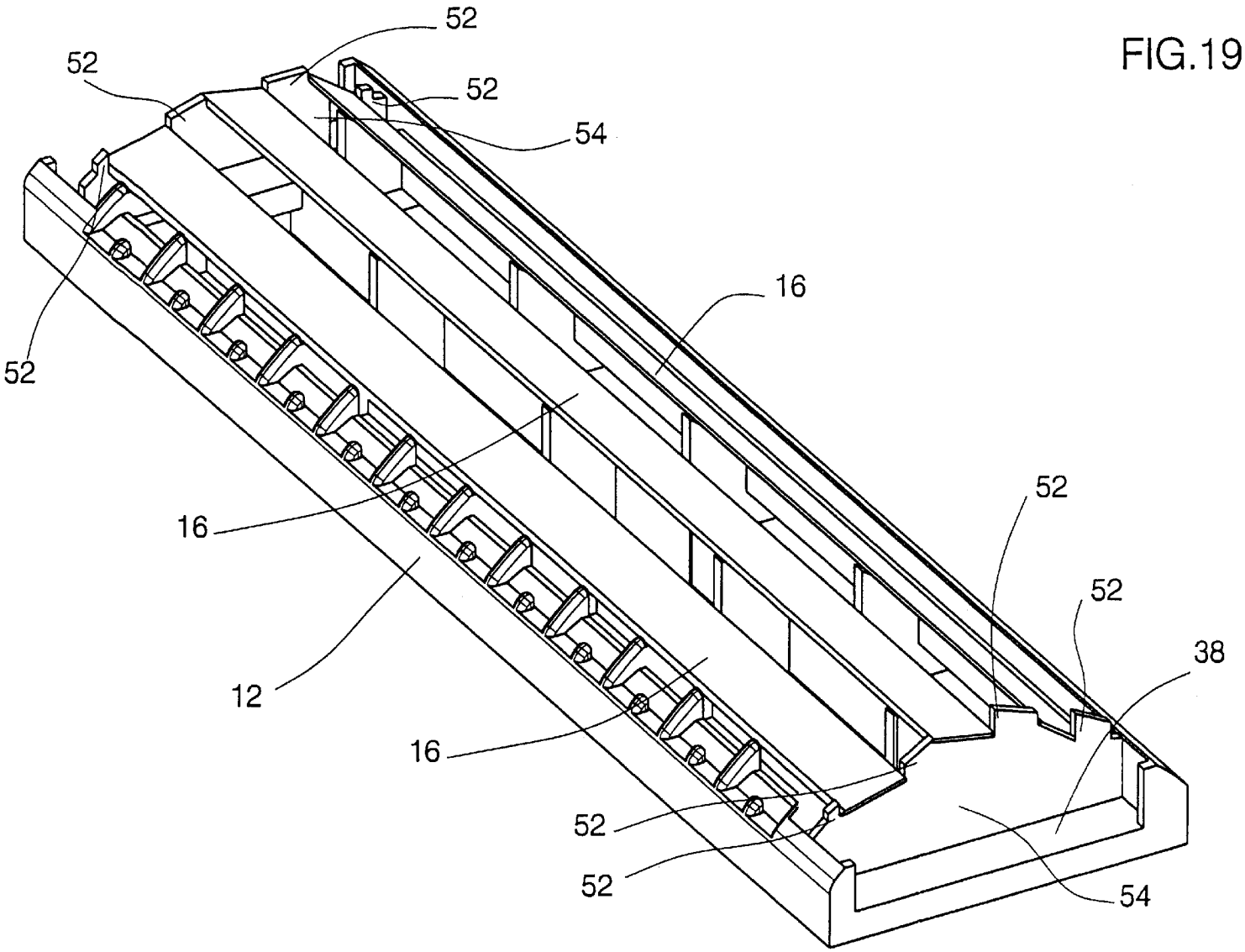
FIG. 19 is an isometric view of the base and blades of a variant implementation of the razor cartridge of FIG. 8, constructed and operative according to the teachings of the present invention, during assembly.

Specifically, referring first to FIG. 19, base 12 is here formed with a plurality of projecting locating elements 52, in this case shown as part of an additional rib 54 adjacent to sockets 38. The spaces between projecting locating elements 52 define a plurality of blade-receiving receptacles which, as in the previous implementation, preferably each have a width slightly less than the width of the blades. As a result, when a blade 16 is inserted into each of the blade-receiving receptacles, it becomes wedged between the adjacent projecting locating elements 52 so that it is retained in position during the remainder of the assembly process. Here again, the positioning of the locating elements near the ends of the cartridge, preferably within about 5% of the length of the blade nearest the ends of the blade, ensures that any damage to the blades resulting from this wedging effect occurs only near the end portions of the blades where the cutting edge is anyway not operative.

Figure 20:
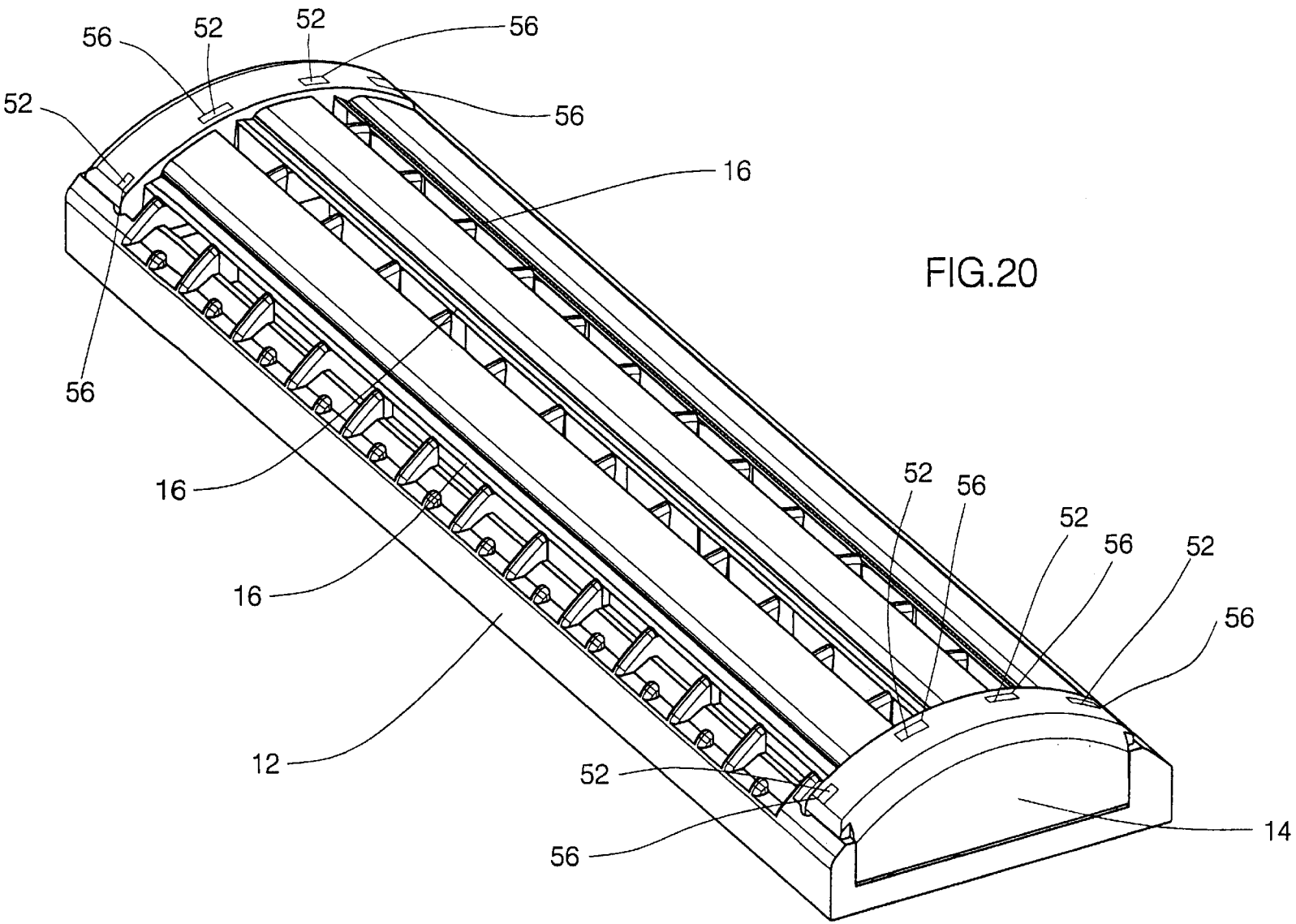
FIG. 20 is an isometric view of the razor cartridge of FIG. 19 after attachment of its cover.

In order to accommodate the height of the non-retractable projecting locating elements 52, cover 14 is preferably formed with a plurality of recesses 56 which receive the ends of projecting locating elements 52 when assembled (see FIG. 20). In all other respects, the structure and method of assembly of the cartridge of FIGS. 19 and 20 may be fully understood by analogy to the structure and method described above.

It will be appreciated that the above descriptions are intended only to serve as examples, and that many other embodiments are possible within the spirit and the scope of the present invention.

What is claimed is:

1. A razor cartridge comprising:

(a) a plurality of substantially planar blades, each of said blades having a cutting edge extending along substantially all of a major dimension termed length, each of said blades having an uninterrupted upper surface, a lower surface, and a width measured across said upper surface perpendicular to said length of no more than about 4 mm;

(b) a base having at least one series of spaced-apart ribs configured to provide abutment features for abutting said lower surface of each of said blades so as to define at least partially a predetermined mounting position of each of said blades; and (c) a cover configured for engaging said base to form a unitary cartridge structure, said cover providing at least one abutment surface for each of said blades, said at least one abutment surface being configured to abut said upper surface of a corresponding one of said blades, thereby pressing said blade against said corresponding series of abutment features so as to retain said blade in said predetermined mounting position.

2. The razor cartridge of claim 1, wherein each of said spaced-apart ribs provides at least two projecting abutment features, said projecting abutment features defining localized regions of abutment with said lower surface.

3. The razor cartridge of claim 1, wherein said plurality of blades is implemented as three blades.

4. The razor cartridge of claim 1, wherein said spaced-apart ribs define a mounting position for each of said blades such that said blades are non-overlapping.

5. The razor cartridge of claim 1, wherein said spaced-apart ribs define mounting positions for said blades in which said upper surfaces are non-parallel.

6. The razor cartridge of claim 1 further comprising a plurality of projecting locating elements integrally formed with, and projecting from, one of said base and said cover so as to define a plurality of blade-receiving receptacles, each of said blade-receiving receptacles being configured to have a width slightly less than a width of each of the blades.

7. A method for assembling a razor cartridge of a type having a plurality of narrow blades retained between two cartridge components which provide opposing sets of blade abutment features, the method comprising:

(a) temporarily inserting a plurality of locating elements through a plurality of apertures formed through a first of the cartridge components so as to define a plurality of blade-receiving receptacles;

(b) inserting a blade into each of said blade-receiving receptacles;

(c) attaching the second of the cartridge components to the first cartridge component so as to form a razor cartridge with the blades retained between the two cartridge components; and (d) withdrawing the locating elements from the first cartridge component.

8. The method of claim 7, wherein said withdrawing is performed substantially simultaneously with said attaching.

9. The method of claim 7, wherein said locating elements are spring-mounted so as to be retractable, at least part of said withdrawing being achieved as a direct result of contact between said locating elements and the second cartridge component during said attaching.

10. The method of claim 7, wherein each of said blade-receiving receptacles is configured to have a width slightly less than a width of each of the blades such that said inserting of the blades results in said blades being temporarily wedged within said blade-receiving receptacles.

11. A method for assembling a razor cartridge of a type having a plurality of narrow blades retained between two cartridge components which provide opposing sets of blade abutment features, the method comprising:

(a) providing a plurality of projecting locating elements projecting from a first of the cartridge components so as to define a plurality of blade-receiving receptacles, each of said blade-receiving receptacles being configured to have a width slightly less than a width of each of the blades;

(b) inserting a blade into each of said blade-receiving receptacles so that it becomes wedged between adjacent ones of said locating elements; and (c) attaching the second of the cartridge components to the first cartridge component so as to form a razor cartridge with the blades retained between the two cartridge components, the second cartridge component being formed with a plurality of recesses for receiving said projecting locating elements.

* * * * *